United States Patent [19]

Tomita

[11] 4,040,396

[45] Aug. 9, 1977

[54] FUEL INJECTION VALVE FOR INTERNAL COMBUSTION ENGINE

[75] Inventor: Hitoshi Tomita, Saitama, Japan

[73] Assignee: Diesel Kiki Co., Ltd., Tokyo, Japan

[21] Appl. No.: 563,002

[22] Filed: Mar. 27, 1975

[30] Foreign Application Priority Data

Mar. 29, 1974 Japan ..... 49-35081[U]

[51] Int. Cl.[2] ..... F02B 3/00; F02M 39/00

[52] U.S. Cl. ..... 123/32 JV; 123/139 AW; 239/494; 239/533.12

[58] Field of Search ..... 239/494, 497, 490, 533; 123/32 JV, 139 AW

[56] References Cited

U.S. PATENT DOCUMENTS

| | | | |
|---|---|---|---|
| 2,102,147 | 12/1937 | Graham | 239/497 |
| 2,213,928 | 9/1940 | Gold | 123/32 JV |
| 2,419,365 | 4/1947 | Nagec | 239/494 |
| 2,779,320 | 1/1957 | Goschel | 123/32 JV |
| 3,695,235 | 10/1972 | Anderson | 123/32 JV |

FOREIGN PATENT DOCUMENTS

| | | | |
|---|---|---|---|
| 709,500 | 5/1954 | United Kingdom | 239/494 |
| 344,897 | 3/1931 | United Kingdom | 239/494 |

*Primary Examiner*—Carroll B. Dority, Jr.
*Assistant Examiner*—Ronald B. Cox
*Attorney, Agent, or Firm*—Sughrue, Rothwell, Mion, Zinn and Macpeak

[57] ABSTRACT

The discharge side of a fuel injection valve is covered by a disc forming a passage member adjacent the valve seat and a disc forming a nozzle member on the opposite side thereof, the passage member having central recesses on opposite sides, radial passages leading from the recess facing the valve seat to through holes at the radially outboard ends of the radial passages passing through the disc and opening up on the opposite face of the passage member to a similar number of passages which extend tangentially from a central circular recess to fluid communicate the small diameter nozzle discharge opening within the discharge member to the circular recess facing a concentric needle valve centered with the valve seat.

3 Claims, 3 Drawing Figures

FUEL INJECTION VALVE FOR INTERNAL COMBUSTION ENGINE

BACKGROUND OF THE INVENTION

1. Field of the Invention

This invention relates to an improvement within a fuel injection valve for an internal combustion engine, and more particularly, to a fuel injection valve characterized by especially low spray speed and high automization of the fuel spray.

2. Description of the Prior Art

Heretofore, variously outwardly opening type fuel injection valves have been proposed for injecting fuel into the suction pipe or intake manifold of gasoline powered, internal combustion engines. In such fuel injection valves, while the spray speed is relatively high, the spray particles are liable to be relatively large in size and as a result, the injected fuel is apt to adhere to the wall of the suction pipe or manifold, and when the adhered fuel is admitted or sucked into the cylinder by suction air during the suction stroke of the piston with the control of fuel quantity is unfavorably lost which has unfavorable effects on control of exhaust gas pollutants.

Heretofore, volute type injection valves have been proposed as a means for promoting atomization of the spray by use of a continuous air current which impacts the liquid spray and facilitates atomization of the fuel particles. In such valves, however, the gyrating current is effected on the upstream side of the valve seat, and the gyrating energy is lost each time the injection of fuel is interrupted. Particularly where small quantities of fuel are injected such as during engine idling, a gyrating current sufficient to promote atomization is in fact not obtained.

SUMMARY OF THE INVENTION

It is therefore the object of the present invention to eliminate the above-mentioned drawbacks of conventional fuel injection valves by providing a member which utilizes the injection energy for creating a gyrating current at the downstream side of the valve seat so as to shorten the travel distance of the spray mist and to intensify the atomization of that spray.

Specifically, the improvement is directed to a fuel injection valve for an internal combustion engine in which the valve body which supports a spring biased needle valve for reciprocation within a central bore and relative to a valve seat at the discharge end of the valve body bore, is provided with a disc-like passage member having a circular recess concentric with the needle valve on one face, radical passages extending outwardly of the circular recess, through holes communicating with the face opposite that facing the needle valve, a corresponding circular recess on the outer face of the passage member, and tangential fuel passages communicating the through holes to the circular recess on that downstream face and a disc-like nozzle member overlying the passage member and provided with a central, small diameter nozzle hole which is smaller than the circular recess facing the same.

DESCRIPTION OF THE PREFERRED EMBODIMENT

Figure 1:
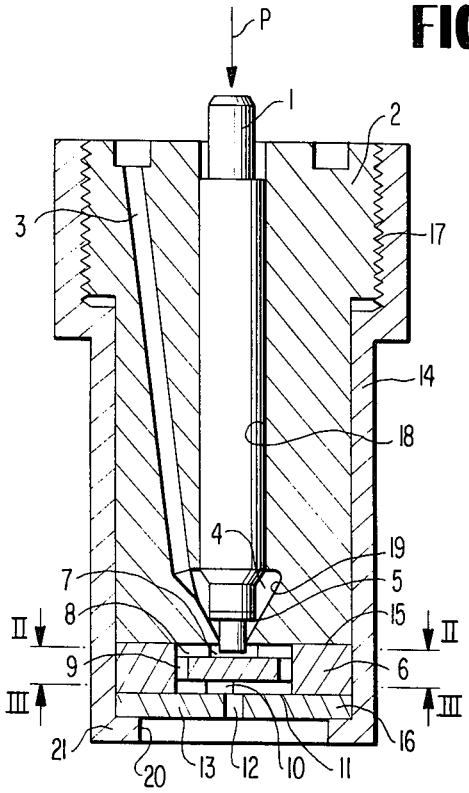
FIG. 1 is a vertical, sectional view showing one embodiment of the present invention.

Referring to the drawings, a needle valve 1 is slidably and sealably supported within a bore 18 extending centrally of valve body 2 constituted by a metal cylindrical member, a diagonal fuel delivery passage 3 opens up to bore 18 at a radially enlarged portion 19 at the tip end of the valve body 2 to form an oil pool 4. The needle valve 1 is pressed against a valve seat 5 by a spring (not shown) providing a biasing force as indicated by the arrow P. Such structural arrangement is common to these injection valve.

Figure 2:
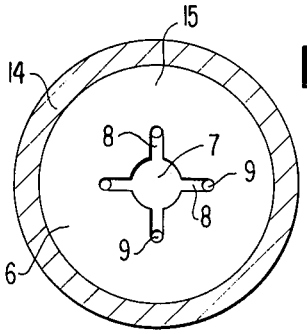
FIG. 2 is a transversal, sectional view of the embodiment of FIG. 1 along line II — II showing the upstream face of the passage member of the fuel injection valve.
Figure 3:
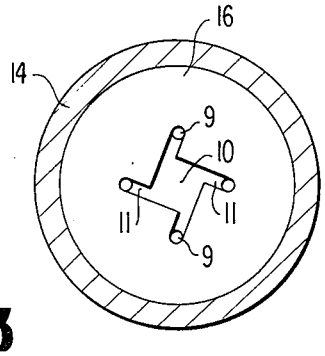
FIG. 3 is a further, transversal, sectional view of the fuel injection valve of FIG. 1 taken about line III — III, showing the downstream face of the passage member.

The present invention is directed to the employment of a passage member or disc 6 which overlies the discharge end of the valve body 2 in contact therewith, and blocks off the downstream end of the valve seat 5 and overlies the tip of the needle valve 1. The sectional views of FIGS. 2 and 3 show the make up of the passage member 6 and respective upstream and downstream faces 15 and 16 of that member. In FIG. 2, face 15 of the passage member 6 is provided with a circular, central recessed portion 7 which is concentric with the needle valve 1. Four circumferentially spaced, radial fuel passages 8 extend outwardly from the circular recess 7, and small diameter through holes 9 are provided at the radially outboard end of the fuel passages 8 and extend from face 15 to face 16 of the passage member. Referring next to FIG. 3, it is noted that the downstream face 16 of the passage member is provided with a central circular recess 10 which is concentric with the needle valve 1 and circular recess 7 on the opposite face. A plurality of tangential fuel passages 11 communicate the through holes 9 laterally with the circular recess 10. The tangential delivery to recess 10 sets up gyratory motion of the fuel. As seen further from FIG. 1, beneath the passage member 6, there is provided a second disc forming a nozzle member 13 which is provided with a central nozzle opening or hole 12, the diameter of which is smaller than that of the circular recess 10 which is concentric therewith. An assembly is formed by the use of a cup-shaped connecting member 14 which is threaded to the valve body 2 by a threaded connection 17, the cup-shaped member being provided with a large diameter opening 20 within the bottom 21 of the connecting member. The connecting member therefore acts to integrate the two discs forming nozzle member 13 and the overlying passage member 6 with the cylindrical valve body 2.

The operation of the improved fuel injection valve of the present invention will now be described. When the pressure of fuel in the fuel delivery hole passage 3 and that of the fuel pool 4 is increased by pressure feeding of the fuel injection pump (not shown but fluid coupled to passage 3), and when the force acting to open the needle valve 1 becomes greater than the biasing force of the spring identified by arrow P which presses the needle valve 1 against the valve seat 5, the needle valve 1 lifts and permits the fuel in the fuel pool 4 under pressure to be delivered to the circular recess 7 of the upstream face of passage member 6. The delivered fuel travels radially outward through the radial fuel passages 8, axially through holes 9, and inwardly through the tangential fuel passages 11 to the circular recess 10 facing the nozzle opening or hole 12 of the nozzle member 13. Thus, the fuel is injected through the nozzle opening 12 while under gyrating motion, since the fuel passages 11 are tangential to the circular recess 10. Thus, as described above, in the fuel injection valve according to the present invention, the travel distance of the spray is relatively short and the atomization is promoted because the fuel, downstream of the valve seat having large injection energy is further provided with gyrating motion.

Consequently, when the fuel injection valve according to the present invention is employed, a reduced amount of the spray hits the wall of the suction manifold, the particles of the fuel spray are of reduced size such that vaporization of fuel is promoted, and the quantity of injected fuel passing directly to the cylinder is accurately controlled. Thus, the invention is quite effective as a counter measure against pollutants within the exhaust gas of the engine incorporating the improved fuel injection valve of the present invention.

While the invention has been particularly shown and described with reference to a preferred embodiment thereof, it will be understood by those skilled in the art that various changes in form and details may be made therein without departing from the spirit and scope of the invention.

What is claimed is:

1. In a fuel injection valve for an internal combustion engine including a valve body having a central bore sealably and slidably mounting a needle valve and formed with an oil pool adjacent a circular valve seat which is closed off by the tip end of the needle valve, the improvement comprising:

a planar passage member fixedly abutting and underlying the discharge end of the valve body, and a planar nozzle member fixedly abutting and underlying said passage member and having a small diameter nozzle opening concentric with the valve seat and needle valve, said planar passage member including on its upstream face, facing said valve body, a first central recess extending radially beyond said circular valve seat and acting as a direct axial extension of the valve body central bore and including an axial end face for deflecting flow radially outwardly, and said planar passage member including circumferentially spaced through holes extending through said passage member parallel to its axis at positions radially outwards of said circular valve seat and being in fluid communication with said upstream face first central recess of said passage member, and at least one of said planar members including a second central recess open to the downstream face of said passage member and overlying said nozzle opening and in fluid communication with said through holes by fluid passages extending tangentially from said second central recess to said through holes, and wherein a plurality of radial passages corresponding to said tangential fluid passages and said through holes are provided within the upstream face of said planar passage member and extend radially outward from the first central recess therein to respective through holes, and said tangential passages lead from said through holes within said downstream face of said passage member to said second central recess whose diameter is in excess of the diameter of said opening within said nozzle member;

whereby, fuel entering said second central recess by way of said tangential fluid passage is subjected to a gyrating flow prior to immediate discharge through the central nozzle opening with improved atomization thereof.

2. In a fuel injection valve for an internal combustion engine including a valve body having a central bore sealably and slidably mounting a needle valve and formed with an oil pool adjacent a circular valve seat which is closed off by the tip end of the needle valve, the improvement comprising:

a planar passage member fixedly abutting and underlying the discharge end of the valve body, and a planar nozzle member fixedly abutting and underlying said passage member and having a small diameter nozzle opening concentric with the valve seat and needle valve, said planar passage member including on its upstream face, facing said valve body, a first central recess extending radially beyond said circular valve seat and acting as a direct axial extension of the valve body central bore and including an axial end face for deflecting flow radially outwardly, and said planar passage member including circumferentially spaced through holes extending through said passage member parallel to its axis at positions radially outwards of said circular valve seat and being in fluid communication with said upstream face first central recess of said passage member, and at least one of said planar member including a second central recess open to the downstream face of said passage member and overlying said nozzle opening and in fluid communication with said through holes by fluid passages extending tangentially from said second central recess to said through holes, and wherein said central recess is provided within the downstream face of said passage member, a plurality of radial passages corresponding to said tangential fluid passages and said through holes are provided within the upstream face of said planar passage member and extend radially outward from the first central recess therein to respective through holes, and said tangential passages led from said through holes within the downstream face of said passage member to said second central recess whose diameter is in excess of the diameter of said opening within said nozzle member;

whereby, fuel entering said second central recess by way of said tangential fluid passage is subjected to a gyrating flow prior to immediate discharge through the central nozzle opening with improved atomization thereof.

3. In a fuel injection valve for an internal combustion engine including a valve body having a central bore sealably and slidably mounting a needle valve and formed with an oil pool adjacent a circular valve seat which is closed off by the tip end of the needle valve, the improvement comprising:

a planar passage member fixedly abutting and underlying the discharge end of the valve body, and a planar nozzle member fixedly abutting and underlying said passage member and having a small diameter nozzle opening concentric with the valve seat and needle valve, said planar passage member including on its upstream face, facing said valve body, a first central recess extending radially beyond said circular valve seat and acting as a direct axial extension of the valve body central bore and including an axial end face for deflecting flow radially outwardly, and said planar passage member including circumferentially spaced through holes extending through said passage member parallel to its axis at positions radially outwards of said circular valve seat and being in fluid communication with said upstream face first central recess of said passage member, and at least one of said planar members including a second central recess open to the downstream face of said passage member and overlying said nozzle opening and in fluid communication with said through holes by fluid passages extending tangentially from said second central recess to said through holes, and wherein said valve body comprises a cylindrical member, said planar passage member and said planar nozzle member comprise discs of a diameter equal to the internal diameter of said valve body, and a cup-shaped member slidably receives said valve body and said discs and is threaded to said valve body to capture and press said discs in contact with themselves, with the inner disc in contact with the discharge end of said valve body;

whereby, fuel entering said second central recess by way of said tangential fluid passage is subjected to a gyrating flow prior to immediate discharge through the central nozzle opening with improved atomization thereof.

* * * * *